US009759536B2

(12) United States Patent
Gadams et al.

(10) Patent No.: US 9,759,536 B2
(45) Date of Patent: Sep. 12, 2017

(54) MAGAZINE RETENTION DEVICE

(71) Applicant: HSG, LLC, Swansboro, NC (US)

(72) Inventors: Matthew Gadams, Swansboro, NC (US); Albert Higdon, Hubert, NC (US); Rebecca Higdon, Hubert, NC (US)

(73) Assignee: HSG, LLC, Swansboro, NC (US)

( * ) Notice: Subject to any disclaimer, the term of this patent is extended or adjusted under 35 U.S.C. 154(b) by 0 days.

(21) Appl. No.: 14/770,855

(22) PCT Filed: Feb. 27, 2014

(86) PCT No.: PCT/US2014/019169

§ 371 (c)(1),
(2) Date: Aug. 27, 2015

(87) PCT Pub. No.: WO2014/134368

PCT Pub. Date: Sep. 4, 2014

(65) Prior Publication Data

US 2016/0003598 A1 Jan. 7, 2016

Related U.S. Application Data

(60) Provisional application No. 61/770,308, filed on Feb. 27, 2013.

(51) Int. Cl.
*F42B 39/00* (2006.01)
*F42B 39/02* (2006.01)
(Continued)

(52) U.S. Cl.
CPC ..... *F42B 39/02* (2013.01); *B65D 25/04* (2013.01); *B65D 25/20* (2013.01); *B65D 63/10* (2013.01)

(58) Field of Classification Search
CPC ..... F42B 39/02; F42B 39/00; F42B 39/08; F41A 9/65; F41A 9/68; B65D 25/00; B65D 25/04
(Continued)

(56) References Cited

U.S. PATENT DOCUMENTS 900,094 A * 10/1908 Fisher ..... A45F 3/00 2/247
6,634,131 B1 10/2003 Fitzpatrick
(Continued)

OTHER PUBLICATIONS

HSGI TACO Magazine Pouch Review, Chairsoft-Press.com, archived Oct. 12, 2011, 7 pages [retrieved from: https://web.archive.org/web/20111012180939/http:I/chairsoftpress.com/reviews/gear/hsgi-taco-magazine-pouch-review/].
(Continued)

*Primary Examiner* — Steven A. Reynolds
*Assistant Examiner* — Javier A Pagan
(74) *Attorney, Agent, or Firm* — Russell D. Nugent; Mark S. King

(57) ABSTRACT

An apparatus for the secure stowing of a magazine, the apparatus comprising a pocket defined by a first pair of opposing side panels and a second pair of opposing side panels, the first pair of opposing side panels being in substantially perpendicular plane to the second pair of opposing side panels and the first pair of opposing side panels being shorter in height than the second pair of opposing side panels, a bottom panel, and a top opening; biasing means whereby at least one pair of opposing side panels are biased toward one another; and means of attachment whereby the pocket may be attached to a person or object.

13 Claims, 6 Drawing Sheets

(51) Int. Cl.
*B65D 25/04* (2006.01)
*B65D 25/20* (2006.01)
*B65D 63/10* (2006.01)

(58) Field of Classification Search
USPC ..... 224/239, 236, 237, 240, 931; 206/3
See application file for complete search history.

(56) References Cited

U.S. PATENT DOCUMENTS

| | | | | |
|---|---|---|---|---|
| 7,918,371 | B2 * | 4/2011 | Wilson | F42B 39/02 224/196 |
| 8,231,038 | B2 * | 7/2012 | Felts | A45F 5/02 224/665 |
| 8,485,405 | B2 | 7/2013 | Crye | |
| 9,394,080 | B2 * | 7/2016 | Beck | B65D 21/08 |
| 2005/0056643 | A1 * | 3/2005 | Hagan | A45C 7/0077 220/9.3 |
| 2007/0017947 | A1 * | 1/2007 | Fenton | A45C 7/0063 224/650 |
| 2007/0228099 | A1 * | 10/2007 | Beda | A45C 11/00 224/666 |
| 2011/0006090 | A1 | 1/2011 | Bollard | |
| 2013/0082080 | A1 | 4/2013 | Hellweg | |
| 2013/0248566 | A1 | 9/2013 | Solomon | |

OTHER PUBLICATIONS

HSGI Bungee Installation [SIC] on a TACO, uploaded Jul. 9, 2010, 2 pages [retrieved from: https://www.youtube.com/watch?v=PVkqGEVu_Ko].

HSGI Open Top Universal Mag Pouch Modular, Double, skdtac.com, archived Jan. 21, 2012, 3 pages [retrieved from https://web.arch ive .org/web/20120121030732/http://www.skdtac.com/HSGI-Open-Top-Universal-Mag-Pouch-Mod ular-p/hsg .226 .htm].

HSGI 'TACO' Modular Single Rifle Magazine Pouch, sdktac.com, archived Oct. 31, 2011, 3 pages [retrieved from: http://www.skdtac.com/HSGI-TACO-Modular-Single-Rifle-Magazine-Pouch-p/hsg.227.htm].

* cited by examiner

MAGAZINE RETENTION DEVICE

CROSS-REFERENCE TO RELATED APPLICATIONS

This application claims the benefit of priority to U.S. Provisional Application No. 61/770,308 filed Feb. 27, 2013. This application further claims the benefit of priority to PCT Application Number PCT/US14/19169 filed on Feb. 27, 2014 and claiming priority to U.S. Provisional Application No. 61/770,308 filed Feb. 27, 2013. The content of both U.S. Provisional Application No. 61/770,308 and PCT Application Number PCT/US14/19169 filed on Feb. 27, 2014 are incorporated by reference herein in their entirety.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION (a) Field of the Invention

The present invention is in the technical field of devices designed for the holding of ammunition. More particularly, the present invention is in the technical field of devices designed to retain and secure ammunition magazines to the person, clothing, or gear of a user.

(b) Background Art

The prior art in the technical field consists largely of devices for the retention and securing of ammunition magazines comprising a pouch having an upward-oriented opening, a flap mechanism that obstructs the upward-oriented opening when the flap mechanism is engaged and closed, means for fastening the flap mechanism in a closed position and means of attachment whereby the pouch is either an integrated feature of the clothing of a user or may be otherwise attached to the clothing or accessories worn by a user.

The aforementioned prior art, while functional as a device to retain and secure ammunition magazines, leaves much to be desired in ease of use and speed of access to a stored magazine. Namely, the flap mechanism prevalent in the prior art effectively restrains an ammunition magazine from falling out of the pouch through the upward-oriented opening, however, the flap mechanism also obstructs a user from quickly and efficiently grasping the magazine when needed to transfer the magazine from the pouch to an otherwise unloaded weapon. Further, the flap mechanism prevalent in the prior art requires at least two dedicated user motions for the task of negotiating the flap mechanism—a first motion to unfasten the flap mechanism, and a second motion to restrain the flap mechanism from continuing to obstruct user access to the magazine contained within the pouch. These two additional motions are unnecessary in the primary goal of grasping, transferring, and loading an ammunition magazine into an unloaded weapon. In combat circumstances the delay occasioned by the two additional motions necessary to negotiate the flap mechanism can be the difference between life and death for a user.

Also known in the prior art are devices for the retention and securing of ammunition magazines comprising a pouch having an upward-oriented opening, no flap mechanism, and means of attachment whereby the pouch is either an integrated feature of the clothing of a user or may be otherwise attached to the clothing or accessories worn by a user. Devices of this type are frequently configured so that the volume within the pouch approximates the volume of a particular ammunition magazine designed to fit within the pouch. In this sense, the pouch without flap mechanism known in the prior art attempts to provide a tight fit for the contemplated ammunition magazine and, by virtue of the force of friction between the interior of the pouch and the magazine therein contained, endeavors to securely retain and store the ammunition magazine.

While the above-referenced devices featuring a pouch without a flap mechanism known in the prior art dispense with unnecessary motions in negotiating the flap mechanism and thereby improve the speed and efficiency whereby a user might grasp, transfer and load an ammunition magazine into an unloaded weapon, the omission of the securing flap leaves the ammunition magazine insecure and vulnerable to jarring or forces that might inadvertently cause the ejectment or loss of the magazine through the top opening of the pouch. Further, the tailoring of the pouch in these devices to ensure a tight fit for a specific magazine begets a lack of universality in ability to securely retain and store ammunition magazines of varying shapes and sizes. Each pouch tends to be designed for a particular size and shape of magazine and, therefore, a single user may need to acquire several of these devices in varying sizes and designs to effectively secure, store and retain a variety of differing magazines.

Further, the prior art features a precursor to the now disclosed invention, the precursor comprising a pocket defined by a front panel, a back panel, a left panel, and a right panel, each of approximately equal length top-to-bottom, a bottom panel and a top opening, biasing means whereby the left and right panels are biased toward one another, biasing means whereby the front and back panels are biased toward one another, and means of attachment whereby the pocket may be attached to a person or object. The effect of the inwardly biased left and right panels and the inwardly biased front and back panels is to create a pouch that is constantly squeezing any item placed within the pouch. Because the pocket defined by the inwardly biased panels need not be specifically tailored for any particular ammunition magazine, the embodiment exhibits universality in use to secure, store and retain a variety of differing shapes and sizes of ammunition magazines. Further, the inwardly biased paneling of this precursor embodiment yields a pocket wherein the force of friction between the interior of the pocket and the magazine contained is substantially higher than that of a mere tight fit induced by a pouch designed to fit a particular magazine as also known in the prior art. The result of this enhanced frictional force between the interior of the pocket and the magazine contained is that the magazine is more securely held and less susceptible to ejectment or loss through jarring or other inadvertent force acting upon the device or the magazine.

While the identified precursor prior art represents a significant improvement over the other prior art known, the precursor prior art has its own shortcoming in that the design tends to cause loss of ammunition from the magazine during transfer of the magazine from the precursor pocket to the unloaded weapon. Modern ammunition magazines are nearly universally configured to be rigid in composition, slender and elongated in shape, and having a first end wherein the magazine housing is completed enclosed and a second end wherein the ammunition contained within the magazine housing is exposed. Ammunition magazines are frequently stored in magazine pouches, pockets and holders so that the magazine end having ammunition exposed is at the bottom of the pocket, pouch or holder. As described, the now discussed precursor prior art has the shortcoming that the inward biasing of the left and right panels defining the pocket coupled with the equivalent, or nearly equivalent, top-to-bottom length of all four panels defining the pocket, results in the frequent catching of a round of ammunition on the inwardly biased left or right panel and the subsequent dislodging of the round of ammunition from its otherwise securely stored position within the magazine. Upon the motion of a user transferring the magazine from the precursor device to an unloaded weapon, the biased left and right panels defining the pocket of the device constantly squeeze any object positioned between the panels and progressively shift from clamping the exterior rigid body of the magazine to clamping upon the exposed round of ammunition as the body of the magazine slides out of the pocket in transition to the weapon. As with the introduction of two additional motions necessary to negotiate the flap mechanism in the other known prior art, the loss or waste of ammunition caused by the clamping of the precursor prior art device upon an exposed round will cause a user to either (i) waste time recovering and reinserting the dislodged round into the magazine, or (ii) run out of ammunition sooner, each result possibly causing the unnecessary wounding or death of the user in a combat circumstance.

BRIEF SUMMARY OF THE INVENTION

The now-disclosed invention, in its broadest articulation, is an apparatus for the secure stowing of a magazine, the apparatus comprising a pocket defined by a first pair of opposing side panels of substantially the same height and a second pair of opposing side panels also of substantially the same height, the first pair of opposing side panels being in substantially perpendicular plane to the second pair of opposing side panels and the first pair of opposing side panels being shorter in height than the second pair of opposing side panels, a bottom panel, and a top opening; biasing means whereby at least one pair of opposing side panels are biased toward one another; and means of attachment whereby the pocket may be attached to a person or object.

The above-stated broadest articulation of the now-disclosed invention may be restated with varying amounts of specificity directed at varying features of the invention to give rise to a number of different embodiments that do not stray from the inventive essence of the contemplated invention. For example, the inventors contemplate that one pair of opposing side panels will be left and right opposing side panels, and one pair of opposing side panels will be front and back opposing side panels, the four recited side panels defining a pocket when coupled with a bottom panel. As such, the inventors further contemplate that either the left and right opposing side panels or the front and back opposing side panels may be designed to be the shorter in height as specified in the broad articulation. It is further contemplated that (i) the left and right opposing side panels, or (ii) the front and back opposing side panels, or (iii) both pairs of opposing side panels may feature biasing means whereby the respective pairs or opposing side panels are biased toward one another.

Similarly, it is appreciated that the biasing means featured in the broadest articulation could take a number of forms. For instance, the biasing means could be as simple as a shock cord or bungee wrapped around the exterior of a pair of opposing panels, thus pulling the panels toward one another. The biasing means could just as easily be a shock cord or bungee wrapped around the exterior of both pairs of opposing panels, and, in fact, this latter contemplated embodiment of the biasing means is representative of the inventors' believed best mode of the now disclosed invention. Likewise, the biasing means could be the simple spring-action of a singular and rigid molded component comprising a pair of opposing side panels and the bottom panel of the now disclosed invention. By molding this component in such a way that the opposing side panels are not parallel to one another, but rather converging, resistance is created when any object is placed between the opposing side panels wedging them apart. In fact, this disclosed singular and rigid molded component comprising a pair of opposing side panels and the bottom panel of the now disclosed invention is also representative of the inventors' believed best mode of the now disclosed invention.

Still further, it is appreciated that the degree of height differential as between the two pairs of opposing side panels now contemplated is an aspect of the invention that may be variable. The inventive essence of the disclosed invention is captured in the fact that the height differential exists, and not in the specific degree of that differential. That said, certain degrees of height differential will recognized as beneficial, specifically those degrees of differential that allow avoidance of the clamping of an inwardly biased side panel upon an exposed round of ammunition at the dispensing end of a magazine as the magazine is removed from the inventive retention device and transitioned to a weapon.

In practice, the now disclosed invention defines a pocket, pouch or well for the retention and storing of an ammunition magazine. One of ordinary skill in the art will appreciate that a pocket, pouch, or well may further comprise a divider that segments the pocket, pouch, or well into two or more separate compartments, each compartment being capable of the storage of an ammunition magazine under the principles of the invention herein disclosed. In fact, one preferred embodiment of the now disclosed invention accomplishes that very feat, a segmented pocket, pouch or well for the retention and storage of an ammunition magazine.

In all embodiments of the inventive device, the inventive essence that improves upon the known prior art is the differential in height between a first pair of opposing side panels of a first height and a second pair of opposing side panels of a second, greater height coupled with biasing means whereby at least one pair of opposing side panels are biased inwardly toward one another. The result is a pocket applying constant frictional force to the sides of an inserted magazine, but which allows the magazine to be rotated out of the pocket once withdrawn far enough that a round of ammunition may clear the shorter pair of opposing side panels and the magazine may be laterally rotated out of the pocket while the taller pair of opposing side panels continue to apply frictional force against the rigid sides of the ammunition magazine. Hence, a round of ammunition exposed at the base of an ammunition magazine is released from the pocket without being caught or hung on an inwardly biased side of the pocket, a substantial problem in the known prior art. Further, the continued use of inward biasing of at least one pocket panel continues to allow constant pressure of frictional force against the rigid exterior of the magazine, thus allowing the secure retention and stowing of the magazine despite jarring or other forces acting on the magazine to cause it to eject or be inadvertently released from the top opening of the pocket.

It is a primary objective of the herein disclosed invention to provide for the secure storage and retention of at least one ammunition magazine without causing a loss or waste of ammunition rounds upon removal of the magazine and transfer of the same to a weapon.

It is a further primary objective of the now disclosed invention to provide a device capable of securely stowing a variety of items that a user may carry and require to be conveniently accessible, including, without limitation, a rifle magazine, a pistol or handgun, a flashlight, a cellular telephone, a medication dispenser or storage bottle, a notepad, a keyring, a remote control, a stun gun or taser device, a folding knife, a pepper spray canister, or the like.

It is a further objective of the now disclosed invention to provide a device capable of securely stowing a variety of items that itself is extraordinarily durable for use under heavy use and/or extreme conditions.

It is a still further objective of the now disclosed invention to provide a retention device that swallows and retains just about anything that is roughly the same size as the pouch, pocket or well featured in the device.

It is a still further objective of the now disclosed invention to provide a retention device comprising a pouch, pocket or well defined by two pairs of opposing side panels and a bottom panel, wherein one of the pairs of opposing side panels is rigid and greater in length than the other pair of opposing side panels, the upper ends of the taller pair of side panels serving as guides for the easy insertion and extraction of items from the device.

These and other advantages and features of the present embodiment are described with specificity below so as to make the present disclosure understandable to one of ordinary skill in the art.

DETAILED DESCRIPTION OF THE INVENTION

Figure 1:
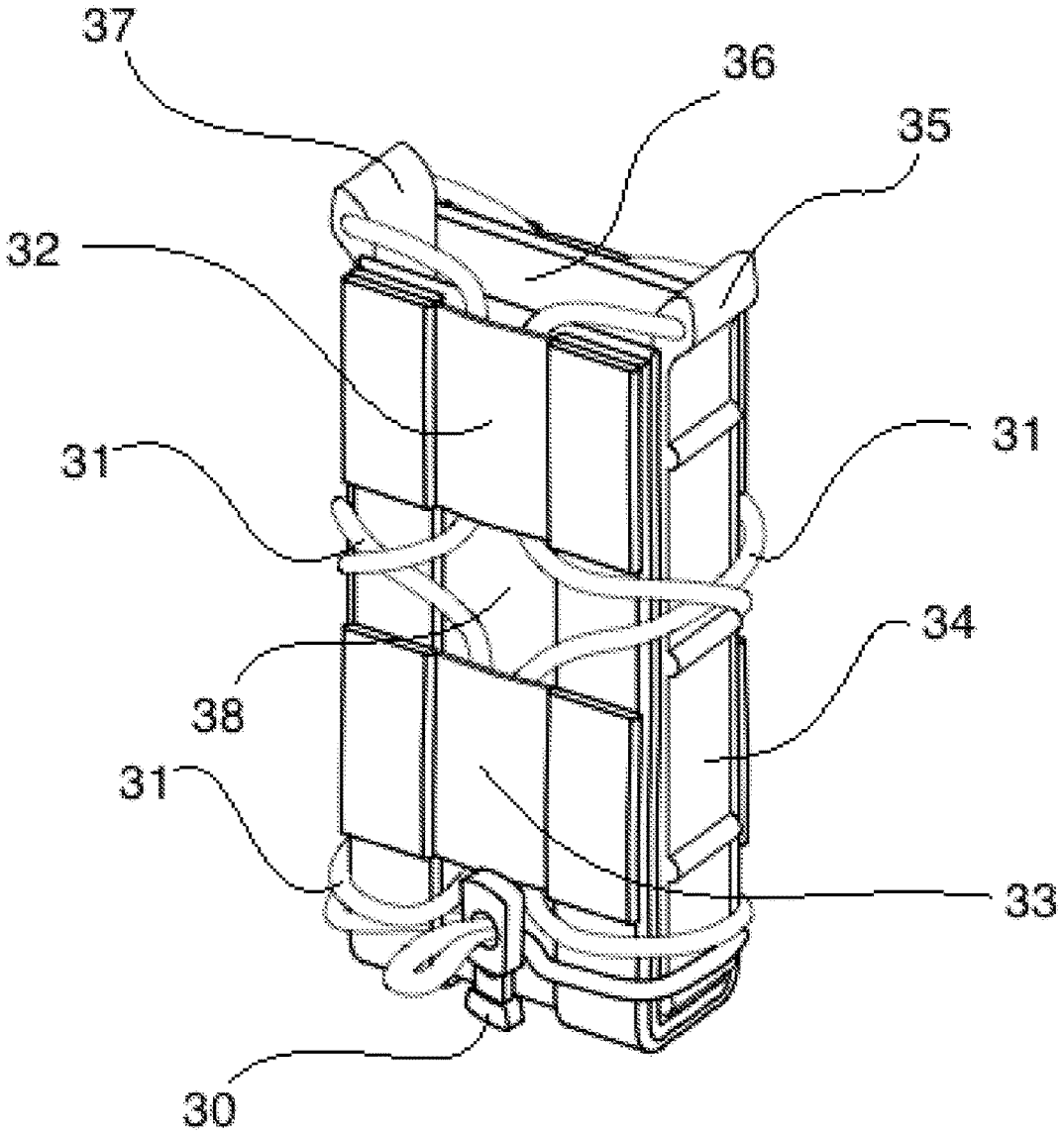
FIG. 1 is a perspective view of a preferred embodiment of the first disclosed present invention.
Figure 3:
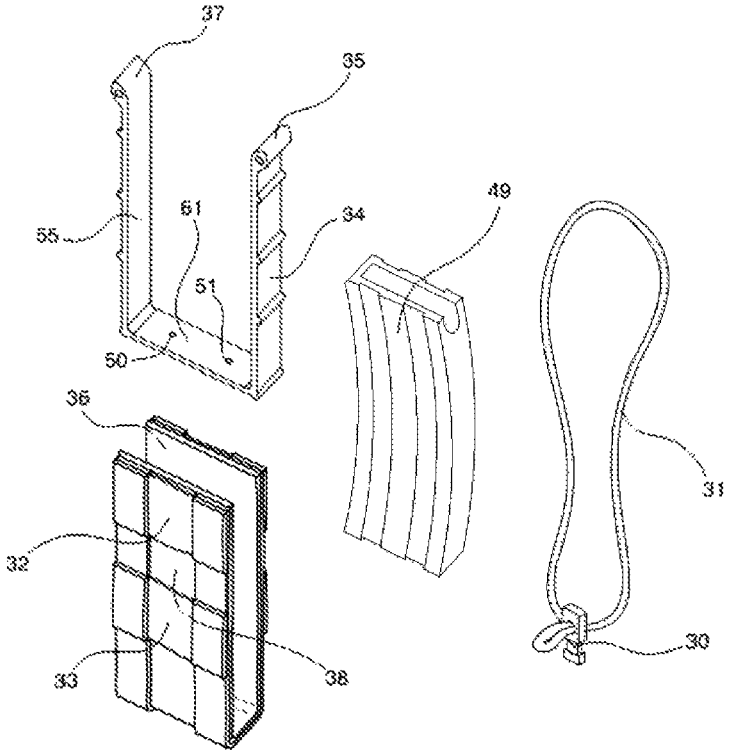
FIG. 3 is a perspective view of the component parts of the preferred embodiment of the first disclosed present invention depicted in FIG. 1.

Referring now to the invention in more detail, in FIG. 1 and FIG. 3 there is shown a first preferred embodiment of the first disclosed invention, FIG. 1 depicting the embodiment and FIG. 3 depicting the component parts of the embodiment to facilitate a more full understanding of the embodiment. Referring now to FIG. 1 and FIG. 3 there is shown a magazine retention device comprising a pocket formed of a single length of pliable material serving as both a front side panel 38 and back side panel 36 and a U-shaped molded structural component riveted to the length of pliable material through a first bottom channel perforation 50 and a second bottom channel perforation 51, thus forming a bottom panel 61, a right side panel 34, and an opposing left side panel 55. Further shown is a distended elastic bungee 31 wrapped about the exterior of the pocket formed by the front side panel 38, back side panel 36, bottom panel 61, right side panel 34, and left side panel 55, the distended elastic bungee 31 held in place by an upper pliable band 32 stitched to the front side panel 38, a lower pliable band 33 stitched to the front side panel 38, an eyelet through the upper left terminus 37 of the left side panel 55, and an eyelet through the upper right terminus 35 of the right side panel 34. The distended elastic bungee 31 is tightened or loosened via manipulation of a slide lock 30 attached to the distended elastic bungee 31. Of further note is the top-to-bottom length differential of the front side panel 38 and the back side panel 36 when compared to the left side panel 55 and the right side panel 34, the upper left terminus 37 of the left side panel 55 and the upper right terminus 35 of the right side panel 34 extending ⅜" above the upper terminus of the front side panel 38 and the upper terminus of the back side panel 36.

In more detail, still referring to the invention of FIG. 1, the embodiment as shown functions as described in this paragraph. In use, an ammunition magazine 49 is inserted into the pocket defined by the front side panel 38, back side panel 36, bottom panel 61, right side panel 34, and left side panel 55, and is securely retained therein by frictional force created by the inward biasing of the front side panel 38 and back side panel 36 and the inward biasing of the left side panel 55 and right side panel 34 as against the exterior housing of the inserted ammunition magazine 49. When the apparatus is attached to the person of a user, the device allows a user to freely engage in rigorous activities while remaining confident that the ammunition magazines stowed and retained within the device will remain securely stowed and maintained within the device despite what jarring or other forces may act upon the ammunition magazine during activity. Further, the ⅜" top-to-bottom length differential between the upper terminus 37 of the left side panel 55 and the upper terminus 35 of the right side panel 34 when compared to the front side panel 38 and back side panel 36 allows a user to remove the stowed magazine 49 from the device by pulling upward on the magazine 49 until such point as an exposed round of ammunition frequently present at the lower end of a magazine 49 is clear of the front side panel 38 and back side panel 36, but not the left side panel 55 and right side panel 34, at which point the magazine 49 is completely released from the inward biasing and resultant frictional forces applied by the left side panel 55 and right side panel 34 by the user laterally moving the magazine 49 out of the device over the ⅜" shorter front side panel 38 or the ⅜" shorter back side panel 36, thus allowing dispensing of the magazine 49 without contact made to the exposed round of ammunition thereby avoiding the potential dislodging of the same.

In further detail, still referring to the invention of FIG. 1 and FIG. 3, the embodiment as shown is contemplated for use with pistol magazines or clips. One of ordinary skill in the art will appreciate that although the present device is specifically designed to indiscriminately accommodate a variety of differing sized and shaped magazines and clips, the substantial size differential between a typical pistol clip and a typical rifle or machine gun magazine demand at least two varying sizes of the inventive device to accommodate each. While the particular embodiment of FIG. 1 and FIG. 3 is specifically designed to maximize promiscuity of the device as among varying shapes and sizes of pistol clips, it is not contemplated that the same would interchangeably accommodate rifle or machine gun magazines as well.

The construction details of the invention as shown in FIG. 1 and FIG. 3 are that the device is constructed of three primary components: a U-shaped molded structural component that serves as the bottom panel 61, left side panel 55, and right side panel 34 of the device, a length of pliable material wrapped about the U-shaped molded structural component so as to serve as the front side panel 38 and back side panel 36 of the device, and an elastic bungee 31 stretched around the exterior of the U-shaped molded structural component and the length of pliable material. The device is held together by rivets attaching the U-shaped molded structural component to the length of pliable material at the bottom panel 61 of the device, the rivets passing through a first bottom channel perforation 50 in the U-shaped molded structural component and a second bottom channel perforation 51 in the U-shaped molded structural component. The device is further held together by the tension of the elastic bungee 31 when the same is distended around the exterior paneling of the device. The distended elastic bungee 31 further serves as biasing means whereby the front side panel 38 is biased toward the back side panel 36, the back side panel 36 is biased toward the front side panel 38, the left side panel 55 is biased toward the right side panel 34, and the right side panel 34 is biased toward the left side panel 55. The U-shaped molded structural component further serves as biasing means in that the component is molded in such way that the arms of the component comprising the left side panel 55 and right side panel 34 of the device are biased toward each other when at rest and must be forced apart to insert a magazine 49 between the left side panel 55 and right side panel 34. It is contemplated that the pliable length of material forming the front side panel 38 and back side panel 36 is formed of a durable fabric and the U-shaped molded structural component forming the left side panel 55 and right side panel 34 is a unitary component of molded plastic, sufficiently rigid to retain its shape, sufficiently pliable to allow the left side panel 55 and right side panel 34 to be forced apart upon insertion of a magazine 49.

Figure 2:
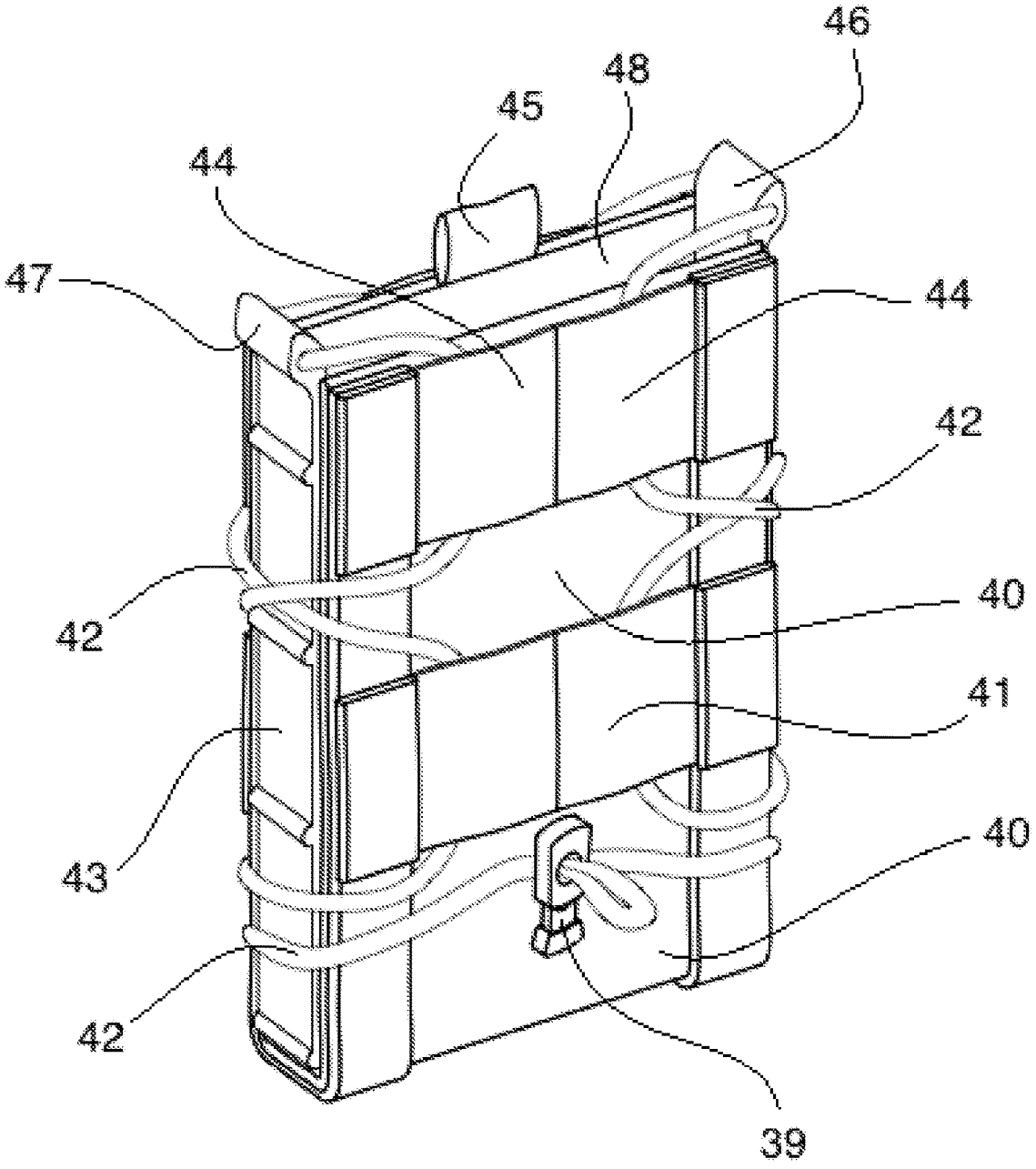
FIG. 2 is a perspective view of another preferred embodiment of the first disclosed present invention.
Figure 4:
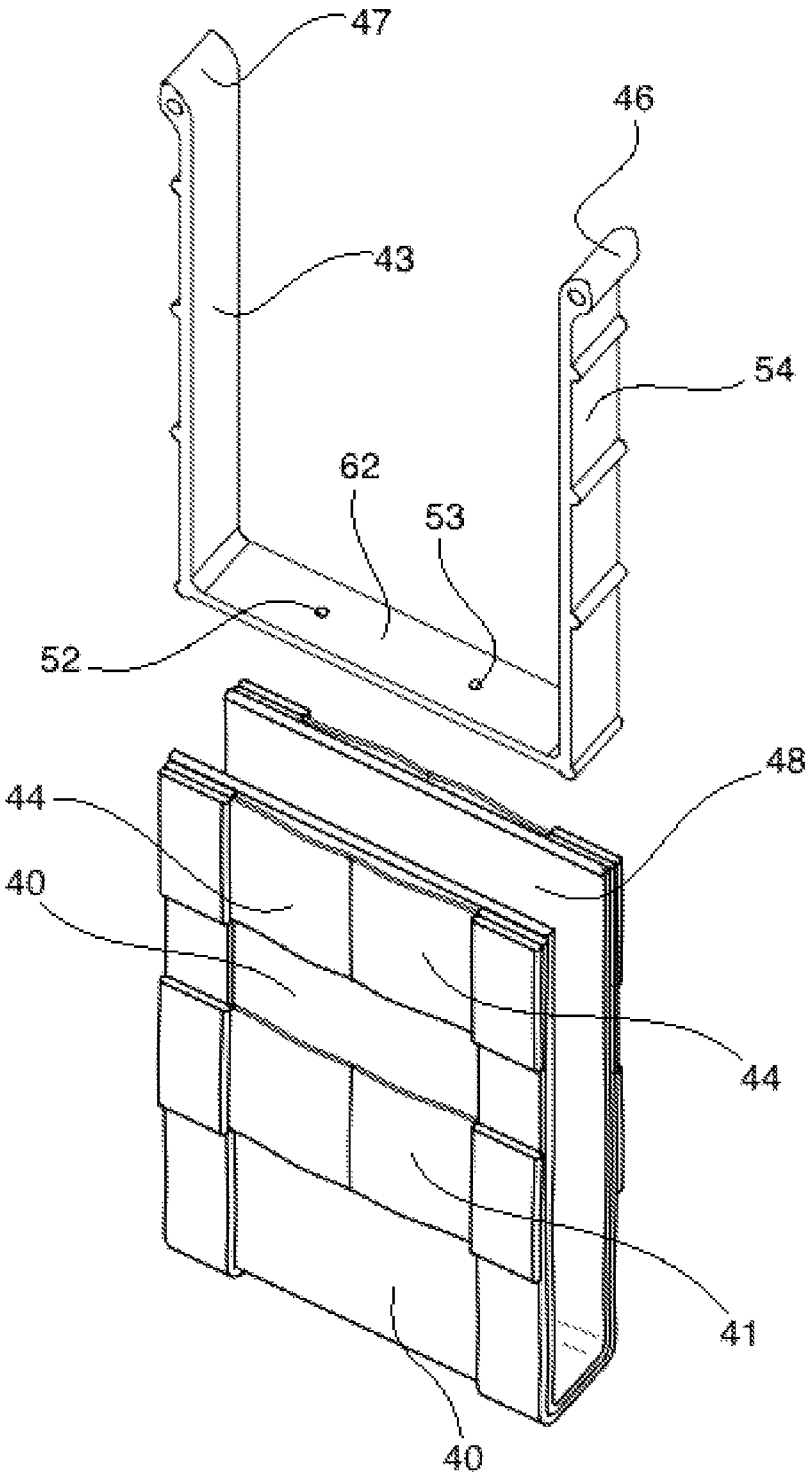
FIG. 4 is a perspective view of the component parts of the preferred embodiment of the first disclosed present invention depicted in FIG. 2.

Referring now to the invention in more detail, in FIG. 2 and FIG. 4 there is shown a second preferred embodiment of the first disclosed invention, FIG. 2 depicting the embodiment and FIG. 4 depicting the component parts of the embodiment to facilitate a more full understanding of the embodiment. Referring now to FIG. 2 and FIG. 4 there is shown a magazine retention device comprising a pocket formed of a single length of pliable material serving as both a front side panel 40 and back side panel 48 and a U-shaped molded structural component riveted to the length of pliable material through a first bottom channel perforation 52 and a second bottom channel perforation 53, thus forming a bottom panel 62, a right side panel 54, and an opposing left side panel 43. Further shown is a distended elastic bungee 42 wrapped about the exterior of the pocket formed by the front side panel 40, back side panel 48, bottom panel 62, right side panel 54, and left side panel 43, the distended elastic bungee 42 held in place by an upper pliable band 44 stitched to the front side panel 40, a lower pliable band 41 stitched to the front side panel 40, an eyelet through the upper left terminus 47 of the left side panel 43, and an eyelet through the upper right terminus 46 of the right side panel 54. The distended elastic bungee 42 is tightened or loosened via manipulation of a slide lock 39 attached to the distended elastic bungee 42. Further, a finger loop 45 extends from the uppermost center terminus of the back side panel 48. An ammunition magazine is inserted into the pocket defined by the front side panel 40, back side panel 48, bottom panel 62, right side panel 54, and left side panel 43, and is securely retained therein by frictional force created by the inward biasing of the front side panel 40 and back side panel 48 and the inward biasing of the left side panel 43 and right side panel 54 as against the exterior housing of the inserted ammunition magazine. Of further note is the top-to-bottom length differential of the front side panel 40 and the back side panel 48 when compared to the left side panel 43 and the right side panel 54, the upper left terminus 47 of the left side panel 43 and the upper right terminus 46 of the right side panel 54 extending ⅜" above the upper terminus of the front side panel 40 and the upper terminus of the back side panel 48. The embodiment depicted in FIG. 2 and FIG. 4 is nearly identical to the embodiment depicted in FIG. 1 and FIG. 3 excepting that the FIG. 2 and FIG. 4 embodiment is configured to be substantially wider than the FIG. 1 and FIG. 3 embodiment and, therefore, is configured to stow and retain larger ammunition magazines than the FIG. 1 and FIG. 3 embodiment.

The invention embodiment depicted in FIG. 2 and FIG. 4 functions in the same manner as the invention embodiment depicted in FIG. 1 and FIG. 3, but for the fact that the embodiment of FIG. 2 and FIG. 4 is intended for use with a rifle or machine gun magazine and not a pistol clip. Likewise, the invention embodiment depicted in FIG. 2 and FIG. 4 is constructed in the same manner as the invention embodiment depicted in FIG. 1 and FIG. 3.

Figure 5:
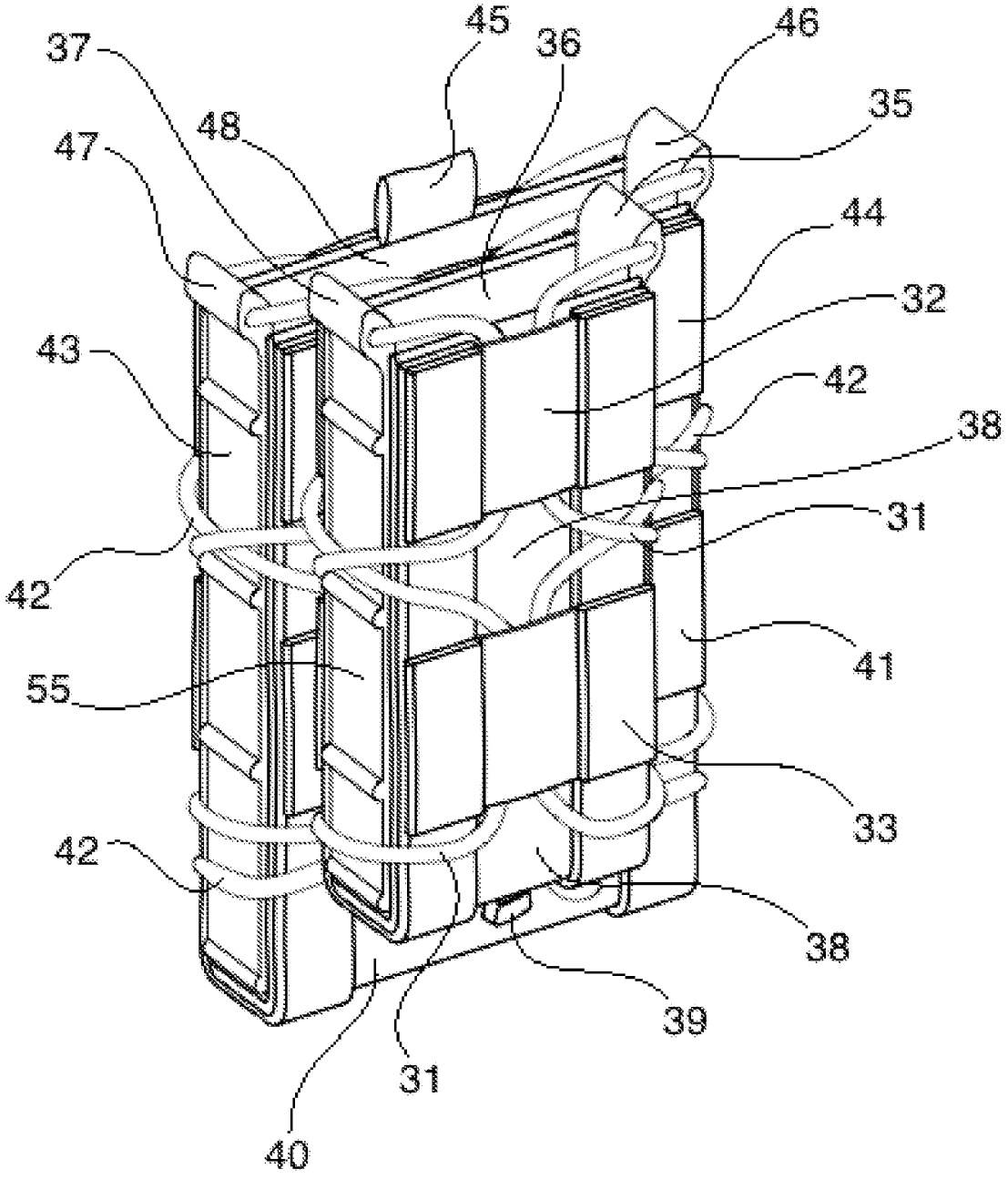
FIG. 5 is a perspective view of another preferred embodiment of the first disclosed present invention.

Referring now to the invention in more detail, in FIG. 5 there is shown a third preferred embodiment of the first disclosed invention. Referring now to FIG. 5 there is shown a magazine retention device comprising the first preferred embodiment identified in FIG. 1 and FIG. 3 affixed to the front side panel 40 of the second preferred embodiment identified in FIG. 2 and FIG. 4. The first preferred embodiment and second preferred embodiment are specifically configured to allow this type of affixation, whether by interplay of distended elastic bungee 42 and distended elastic bungee 31 or other attachment means including but not limited to hook and loop fastening system, and it is expressly contemplated that a combination of embodiments similar to that depicted in FIG. 5 will be frequent in use and, therefore, are deserving of depiction as a third preferred embodiment. Referring now to FIG. 5 in further detail there is shown a magazine retention device having two pockets, a first pocket defined by a front side panel 40, a back side panel 48, a left side panel 43, a right side panel 54, and a bottom panel 62, and a second pocket defined by a front side panel 38, a back side panel 36, a left side panel 55, a right side panel 34, and a bottom panel 61. As depicted, the first pocket is wrapped in a distended elastic bungee 42 that applies constant biasing pressure against the first pocket front side panel 40 and the back side panel 48 and that may be tightened or loosened via manipulation of a slide lock 39 through which the distended elastic bungee 42 is threaded. The first pocket distended elastic bungee 42 is held in place via threading of the bungee 42 through an upper pliable band 44 stitched to the first pocket front side panel 40, a lower pliable band 41 stitched to the first pocket front side panel 40, an eyelet in the upper left terminus 47 of the first pocket left side panel 43, and an eyelet in the upper right terminus 46 of the first pocket right side panel 54. Likewise, the second pocket is wrapped in a distended elastic bungee 31 that applies constant biasing pressure against the second pocket front side panel 38 and the back side panel 36. The second pocket distended elastic bungee 31 is held in place via threading of the bungee 31 through an upper pliable band 32 stitched to the second pocket front side panel 38, a lower pliable band 33 stitched to the second pocket front side panel 38, an eyelet in the upper left terminus 37 of the second pocket left side panel 55, and an eyelet in the upper right terminus 35 of the second pocket right side panel 34. A finger loop 45 extends from the uppermost center terminus of the first pocket back side panel 48. Again, of further note is the top-to-bottom length differential of the first pocket front side panel 40 and the first pocket back side panel 48 when compared to the first pocket left side panel 43 and the first pocket right side panel 54, the upper left terminus 47 of the first pocket left side panel 43 and the upper right terminus 46 of the first pocket right side panel 54 extending ⅜" above the upper terminus of the first pocket front side panel 40 and the upper terminus of the first pocket back side panel 48. Likewise, of further note is the top-to-bottom length differential of the second pocket front side panel 38 and the second pocket back side panel 36 when compared to the second pocket left side panel 55 and the second pocket right side panel 34, the upper left terminus 37 of the second pocket left side panel 55 and the upper right terminus 35 of the second pocket right side panel 34 extending ⅜" above the upper terminus of the second pocket front side panel 38 and the upper terminus of the second pocket back side panel 36.

As above stated, the invention embodiment depicted in FIG. 5 is nothing more than a combination of the two embodiments disclosed in FIG. 1 through FIG. 4. Therefore, there is nothing appreciably different about the manner of function of the embodiment disclosed in FIG. 5 from that of the embodiments disclosed in FIG. 1 through FIG. 4. Likewise, the invention embodiment depicted in FIG. 5 is constructed in the same manner and upon the same principles as taught in the embodiments for FIG. 1 through FIG. 4.

Figure 6:
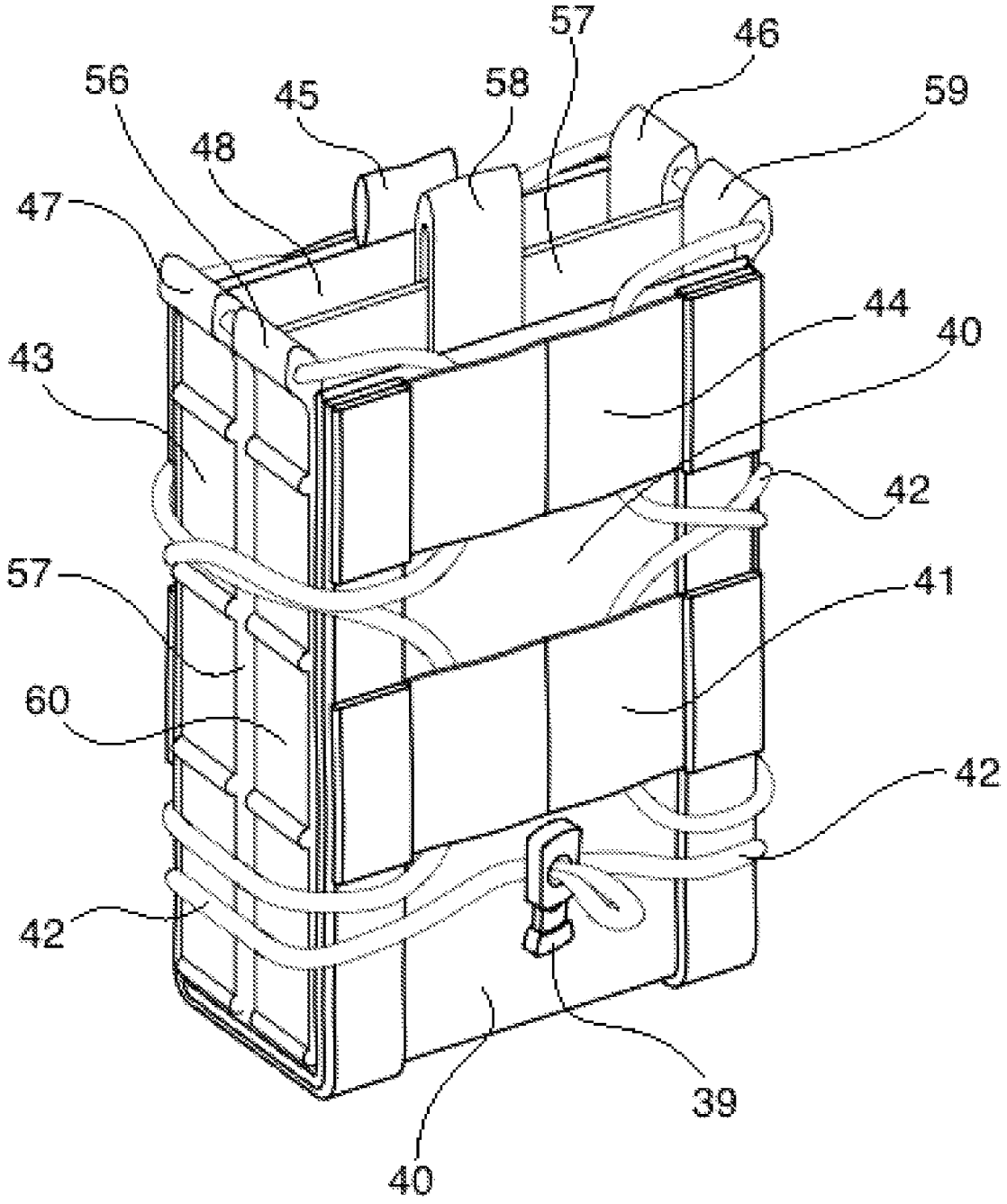
FIG. 6 is a perspective view of a preferred embodiment of the second disclosed present invention.

Referring now to the invention in more detail, in FIG. 6 there is shown a fourth preferred embodiment of the first disclosed invention. Referring now to FIG. 6 there is shown a magazine retention device comprising a divided pocket defined by a front side panel 40, a back side panel 48, a first left side panel 60, a second left side panel 43, a first right side panel (not shown), a second right side panel 54 (not shown), a first bottom panel (not shown), a second bottom panel 60 (not shown), and a divider panel 57 inserted between the first left side panel 60 and second left side panel 43 and further dividing the first and second right side panels (not shown) and the first and second bottom panels (not shown). As in FIGS. 1-5, the fourth preferred embodiment depicted in FIG. 6 is wrapped in a distended elastic bungee 42 that applies constant biasing pressure against the front side panel 40 and the back side panel 48. The distended elastic bungee 42 is held in place via threading of the bungee 42 through an upper pliable band 44 stitched to the front side panel 40, a lower pliable band 41 stitched to the front side panel 40, an eyelet in the upper left terminus 56 of the first left side panel 60, an eyelet in the upper left terminus 47 of the second left side panel 43, an eyelet in the upper right terminus 59 of the first right side panel (not shown), and an eyelet in the upper right terminus 46 of the second right side panel 54 (not shown). The bungee 42 is tightened or loosened via manipulation of a slide lock 39 through which the bungee 42 is further threaded. A first finger loop 45 extends from the uppermost center terminus of the back side panel 48 and a second finger loop 58 extends from the uppermost center terminus of the divider panel 57. As in the embodiments of FIG. 1 through FIG. 5 discussed above, the top-to-bottom length differential of the first left side panel 60 upper terminus 56, the second left side panel 43 upper terminus 47, the first right side panel (not shown) upper terminus 59, and the second right side panel 54 (not shown) upper terminus 46, when compared to the ⅜" shorter front side panel 40 and the back side panel 48 is considered significant in this fourth preferred embodiment of the now disclosed invention.

Referring now to the invention in more detail, the preferred embodiment of FIG. 6 may be utilized for the storage of a plurality of ammunition magazines. More specifically, the preferred embodiment of FIG. 6 is utilized by the stowing and retention of an ammunition magazine on either side or both sides of the divider panel 57. But for this capability of being able to securely store a plurality of ammunition magazines, the functionality of the preferred embodiment depicted in FIG. 6 in all relevant respects identical to those preferred embodiments disclosed herein and depicted in FIG. 1, FIG. 2, FIG. 3, and FIG. 4. In terms of construction, the preferred embodiment of FIG. 6 is constructed using the same principles of the preferred embodiments depicted in FIG. 1 through FIG. 4 with the modification that two identical U-shaped molded structural components are required to be integrated into the construction of the embodiment due to the tendency of the divider panel 57 to not only divide the pocket of the device into two distinct compartments, but also to obstruct the biasing of the first left side panel 60 and the biasing of the first right side panel (not shown) if, in fact, the first left side panel 60 and the first right side panel (not shown) remain a single unitary panel along the respective left and right sides of the pocket. Further, the integration of the divider panel 57 as depicted is an obvious modification of the previously discussed construction principles.

Referring now to the second above disclosed invention, in FIG. 6 there is shown a ⅜" top-to-bottom length differential between front-back side panels and left-right side panels in the depicted embodiment. If the ⅜" top-to-bottom differential identified in FIG. 6 is omitted, the resulting embodiment is a preferred embodiment of the second disclosed invention, an apparatus for the secure stowing of a magazine, the apparatus comprising a divided pocket defined by a front side panel 40, a back side panel 48, a first left side panel 60, a second left side panel 43, a first right side panel (not shown), a second right side panel 54 (not shown), a first bottom panel (not shown), a second bottom panel 60 (not shown), and a divider panel 57 inserted between the first left side panel 60 and second left side panel 43 and further dividing the first and second right side panels (not shown) and the first and second bottom panels (not shown). The divider panel 57 is integrated within the pocket and effectively divides the pocket into a first isolated compartment defined by a front side panel 40, the divider panel 57, a first left side panel 60, a first right side panel (not shown), and a first bottom panel (not shown), and a second isolated compartment defined by a back side panel 48, the divider panel 57, a second left side panel 43, a second right side panel 54 (not shown), and a second bottom panel 60 (not shown).

Referring now to the invention in more detail, the preferred embodiment of FIG. 6 may be utilized for the storage of a plurality of ammunition magazines. More specifically, the preferred embodiment of FIG. 6 is utilized by the stowing and retention of an ammunition magazine on either side or both sides of the divider panel 57. The functionality of the preferred embodiment depicted in FIG. 6 is similar in nearly all relevant respects to those preferred embodiments disclosed herein and depicted in FIG. 1, FIG. 2, FIG. 3, and FIG. 4, however, one of ordinary skill in the art will appreciate that the failure to include a ⅜" top-to-bottom length differential between front-back side panels and left-right side panels in the preferred embodiment of FIG. 6 will result in a device that stows and retains a plurality of ammunition magazines securely, but might cause an exposed ammunition rounds to be dislodged from the bottom end of the magazine upon a user removing the magazine from the device. More specifically, without the referenced ⅜" top-to-bottom length differential, the ammunition magazine is removed by the force of a user pulling upward on the magazine. Because all sides of the pocket are inwardly biased and all sides of the pocket are roughly the same top-to-bottom length, the result is that the bottom of the magazine is pinched between opposing sides of the pocket as the magazine is dispensed from the device. In the course of this pinching action, it is not uncommon for an exposed round of ammunition to be dislodged from the magazine upon contact from a biased side of the pocket. Accordingly, unlike the other preferred embodiments of the first disclosed invention, the preferred embodiment of the second disclosed invention does not require a lateral movement to properly remove the magazine from the device, however, in failing to have a structure and method that avoids unnecessary contact between an exposed round of ammunition and the biased sides of the device, the preferred embodiment of the second disclosed invention remains vulnerable to loss of a dislodged round of ammunition upon removal of a magazine from the device.

In all herein described preferred embodiments and inventions, an elastic bungee wrapping about a pocket defined by opposing left and right side panels, opposing front and back side panels, and a bottom panel is a contemplated component of the invention. Further, it is contemplated that a distended elastic bungee as herein identified has function as both a structural feature of the inventions and an operative agent whereby side panels of the invention are biased as herein provided. As one skilled in the art might appreciate, there are infinite configurations for the wrapping of the elastic bungee about the pocket and no claim is made that the wrapped bungee configuration as depicted in any of FIG. 1, FIG. 2, FIG. 3, FIG. 4, FIG. 5, or FIG. 6 has any specific utility over and above any other configuration of the same. In fact, the wrapped bungee configurations depicted in all herein described preferred embodiments and inventions have been selected by the inventor expressly for aesthetic purposes and not because the particular configuration offers superior utility in design.

Reference throughout the specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout the specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

It is understood that the above described embodiments are only illustrative of the application of the principles of the present invention. The present invention may be embodied in other specific forms without departing from its spirit or essential characteristics. The described embodiment, including the best mode, is to be considered in all respects only as illustrative and not restrictive. The scope of the invention is, therefore, indicated by the appended claims, if any, in conjunction with the foregoing description.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

We claim:

1. An apparatus for the secure stowing of a magazine, the apparatus comprising— a pocket defined by a first pair of opposing side panels of the same height;

a second pair of opposing side panels in a perpendicular plane to the first pair of opposing side panels, the second pair of opposing side panels being of the same height and the first pair of opposing side panels being shorter in height than the second pair of opposing side panels; and wherein the second pair of opposing side panels and the bottom panel comprise a single continuous and rigid component separate from the first pair of opposing side panels;

a bottom panel;

a top opening; and an elastic band wrapped around an exterior of the pocket thereby biasing each panel inwards towards its respective opposing panel and partially closing the top opening when the elastic band is at rest.

2. The apparatus of claim 1 wherein the second pair of opposing side panels that are part of the single continuous and rigid component converge as the second pair opposing side panels extend from the bottom panel towards the top opening such that the second pair of opposing side panels partially close the top opening.

3. The apparatus of claim 2 wherein the first pair of opposing side panels is at least ⅜ inch shorter in height than the second pair of opposing side panels.

4. The apparatus of claim 1 wherein the elastic band is a cord wrapped around the exterior of all four side panels.

5. The apparatus of claim 1 wherein the first pair of opposing side panels is at least ⅜ inch shorter in height than the second pair of opposing side panels.

6. The apparatus of claim 1 further comprising at least one dividing panel whereby the pocket is divided into at least two discrete compartments.

7. An apparatus for the secure stowing of a magazine, the apparatus comprising— a pocket defined by a first pair of opposing side panels of the same height;

a second pair of opposing side panels in a perpendicular plane to the first pair of opposing side panels, the second pair of opposing side panels being of the same height and the first pair of opposing side panels being shorter in height than the second pair of opposing side panels; and a bottom panel;

a top opening; and an elastic band wrapped around an exterior of the pocket thereby biasing each panel inwards towards its respective opposing panel and partially closing the top opening when the elastic band is at rest; and wherein the first pair of side panels form a front and back of the pocket and the second pair of opposing side panels form a left side and a right side of the pocket and the elastic band causes both the front and back of the pocket to be biased inward toward a cavity formed by the first and second pair of opposing side panels of the pocket to be biased inwards towards the cavity formed by the side panels.

8. The apparatus of claim 7 wherein the elastic band is a cord wrapped around the exterior of at least two opposing side panels.

9. The apparatus of claim 7 wherein the second pair of opposing side panels and the bottom panel comprise a single continuous and rigid component separate from the first pair of opposing side panels.

10. The apparatus of claim 9 wherein the second pair of opposing side panels that are part of the single continuous and rigid component converge as the second pair of opposing side panels extend from the bottom panel towards the top opening.

11. The apparatus of claim 7 wherein the front and back of the pocket are at least ⅜ inch shorter in height than the left side and right side of the pocket.

12. An apparatus for the secure stowing of a magazine, the apparatus comprising— a pocket defined by a pair of opposing side panels of the same height;

a pair of opposing front and back panels in a perpendicular plane to the pair of opposing side panels, the opposing front and back panels being of the same height and the pair of opposing front and back panels being at least ⅜ inch shorter in height than the pair of opposing side panels;

the bottom panel and the pair of opposing side panels are a single, rigid U-shaped bracket wherein the pair of opposing side panels of the bracket slope inwards toward each other as they extend away from the bottom panel; and a top opening; and an elastic band or cord wrapped around the exterior of the pair of opposing side panels and the pair of opposing front and back panels biasing the pair of opposing side panels inward toward one another and biasing the pair of opposing front and back panels inward toward the cavity formed by the panels.

13. The apparatus for the secure stowing of a magazine of claim 12, further comprising— at least one dividing panel whereby the pocket is divided into at least two compartments.

* * * * *